United States Patent [19]

Shin

[11] Patent Number: 5,054,481

[45] Date of Patent: Oct. 8, 1991

[54] INFUSION APPARATUS TO SUPPLY COMPRESSED AIR INTO AN INDUSTRIAL MASK

[76] Inventor: Hae-Ryun Shin, Rm.401 Jam-sil Apt. 272, 22 Jamsil-dong, Songpa-Ku, Seoul, Rep. of Korea

[21] Appl. No.: 574,343

[22] Filed: Aug. 29, 1990

[51] Int. Cl.[5] ..... A62B 7/02

[52] U.S. Cl. ..... 128/205.12; 128/204.18; 128/205.25; 128/205.27; 128/205.29; 128/206.12; 128/206.15; 128/206.28

[58] Field of Search ..... 128/204.18, 205.12, 128/205.27, 205.25, 205.29, 206.12, 206.15, 206.28, 207.12, 207.16

[56] References Cited

U.S. PATENT DOCUMENTS

| | | | |
|---|---|---|---|
| 804,272 | 11/1905 | Schwartz | 128/205.12 |
| 1,271,012 | 7/1918 | Blanc | 128/206.28 |
| 1,630,501 | 5/1927 | Steese | 128/205.12 X |
| 2,577,606 | 12/1951 | Conley | 128/205.29 X |
| 2,775,968 | 1/1957 | Polli et al. | 128/205.12 |
| 2,852,023 | 9/1958 | Hamilton et al. | 128/205.12 |
| 3,941,573 | 3/1976 | Chapel | 128/205.27 X |
| 4,141,703 | 2/1979 | Mulchi | 128/206.15 X |
| 4,649,912 | 3/1987 | Collins | 128/205.12 X |
| 4,774,939 | 10/1988 | Disney | 128/205.27 X |
| 4,809,472 | 2/1989 | Jung | 128/207.12 X |

FOREIGN PATENT DOCUMENTS

| | | | |
|---|---|---|---|
| 339487 | 4/1988 | European Pat. Off. | 128/205.27 |

OTHER PUBLICATIONS

MSA Data Sheet 10-00-14; "Duo Flow Combination Breathing Apparatus with Ultra Filter® cartridge"; 1987.

MSA Data Sheet 10-01-14; "Constant Flow or Pressure Demand Duo-Flow TM and Duo-Twin TM Respirators"; 1988.

*Primary Examiner*—Edgar S. Burr
*Assistant Examiner*—Eric P. Raciti
*Attorney, Agent, or Firm*—Finnegan, Henderson, Farabow, Garrett & Dunner

[57] ABSTRACT

An infusion apparatus to supply compressed air into an industrial mask having a "T"-shape decompressing regulator at a first end of which is provided a conventional coupling device while at a second end, inner screw threads are formed into which a pressure reducing bolt is inserted to regulate the opening of an air supply channel below of which there is provided a purification receptacle filled with carbon filter which is linked by a hose to another purification receptacle filled with carbon filter. Inside of the conventional dustproof mask there is provided an air exhaust hose in a circular form the end of which is penetrating out of the mask and connected to said purification receptacle. Another drill coupling adapter is provided between the oiler and compressed air hose of a rock drill. On the sides of the drill coupling adapter three grooves are formed so as to fixedly insert another coupling device into one of the grooves and one of the remaining two grooves is blocked with a plug and the other inserted with an elbow. Where there is no rock drill being in use, the apparatus of the present invention may be connected to a compressed air hose brought into a work site.

5 Claims, 4 Drawing Sheets

INFUSION APPARATUS TO SUPPLY COMPRESSED AIR INTO AN INDUSTRIAL MASK

BACKGROUND OF THE INVENTION

The present invention relates to an infusion apparatus to supply compressed air into an industrial mask worn over the face. It is designed for dustproof and gasproof operation so as to ensure the wearer a stabilized respiratory function through the supply of fresh air. Gas mask is a device worn over the face to prevent the breathing in of poisonous gasses by filtering them out of the air.

Various types of masks have been developed to protect the health of workers at mines and industries generating dangerous gas and dust. Attached to such masks are purification containers containing dust collection filters or a counteragent. For the wearer to breathe, he had to draw a deep breath. This need of an increased respiration when the filter is filled with solid particles, impurities, etc., contributed to the difficulty in breathing.

For a miner who works in a mine pit using a heavy rock drill, inhaling capacity increases rather high, and when working, undesirable atmospheric conditions of the pit often caused combined with various respiratory diseases. It is one of the serious problems which must be addressed.

The present invention has been made essentially in an attempt to overcome the above-mentioned problems, and it is a primary object of the present invention to provide an apparatus designed for constant supply of fresh air into a mask by means of decompressing the compressed air supplied to a rock drill where such a device is being used.

Another object of the present invention is to provide fresh air, where no rock drill is being used, by means of bringing in compressed air into the work site where hazardous gas is being emitted.

The present invention will be understood more fully, while still further objects and advantages will become apparent, in the following detailed description of a preferred embodiment thereof illustrated in the accompanying drawings.

DETAILED DESCRIPTION OF THE PREFERRED EMBODIMENT

Figure 1:
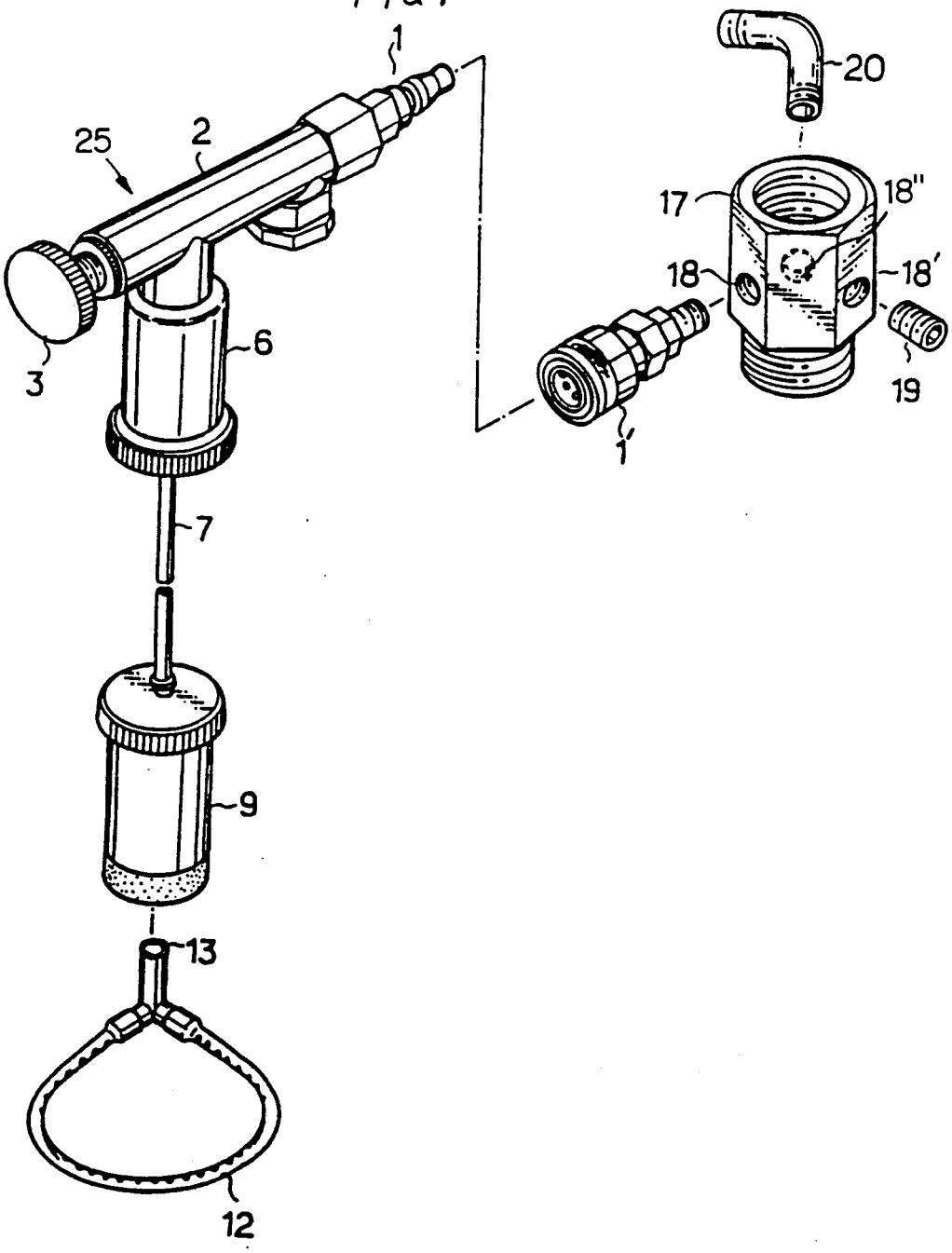
FIG. 1 is a perspective view of an infusion apparatus to supply compressed air into an industrial mask according to a preferred embodiment of the present invention.

The present invention will now be explained in detail by way of a preferred embodiment in conjunction with accompanying drawings herewith:

Referring first to FIG. 1 there is shown an infusion apparatus 25 in a perspective view.

Figure 2:
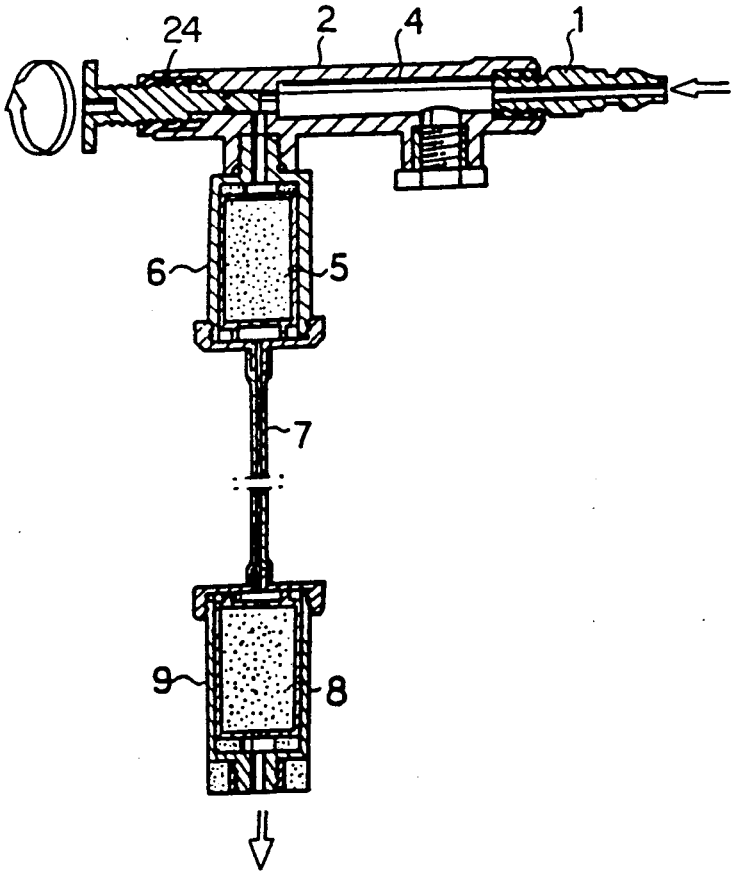
FIG. 2 is a cross-sectional view showing the construction of an infusion apparatus to supply compressed air into an industrial mask.
Figure 3:
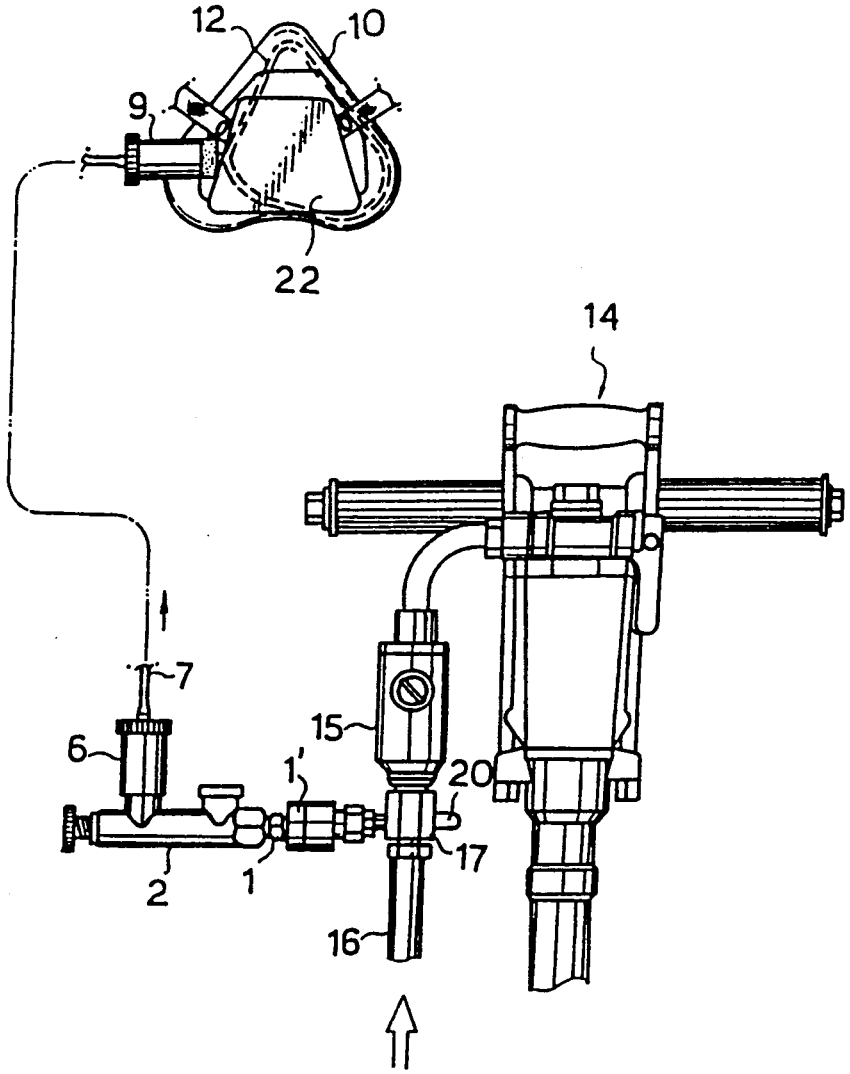
FIG. 3 is a cross-sectional view showing a rock drill connected to a dustsproof mask.
Figure 4:
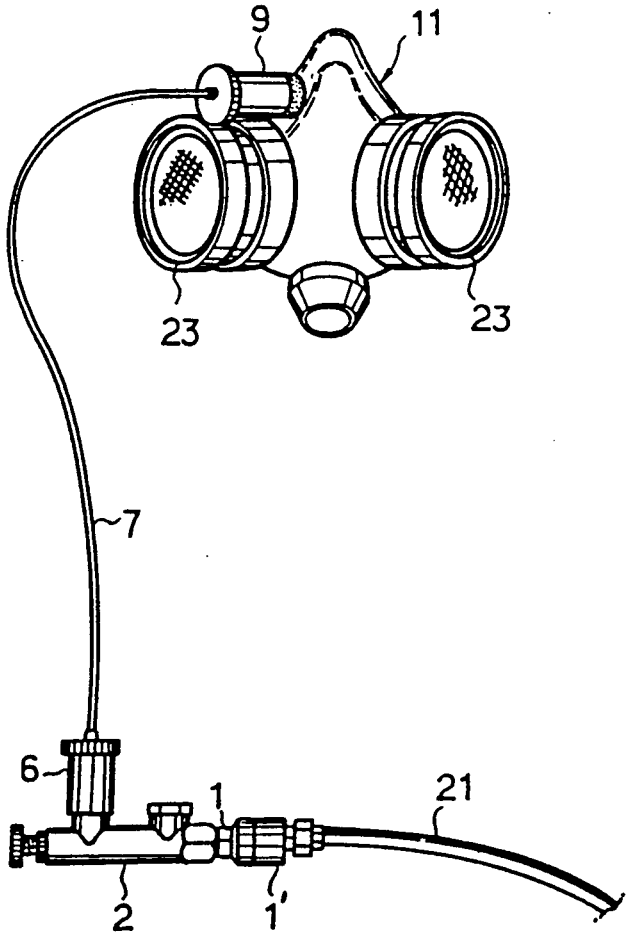
FIG. 4 is a view showing the state in which the compressed air hose is connected to a gas mask.

At a first end of the "T" shape decompressing regulagtor 2 there is provided a first conventional coupling device 1, while at the second end, inner screw threads 24 are formed into which a pressure reducing bolt 3 is inserted so as to regulate the opening of supply channel 4 (see FIG. 2).

Immediately below the supply channel 4 there is provided a purification receptacle 6 filled with carbon filter 5 which is linked by a long hose 7 to another purification receptacle 9 filled with carbon filter 8.

Inside of the conventional dustproof and poisonproof masks 10, 11 there is provided an air exhaust hose 12 in circular form the end 13 of which penetrates out of the mask 10, 11 and connects to said purification receptacle 9.

On the other hand, there is provided another drill coupling adapter 17 between the oiler 15 of a rock drill 14 and the compressed air hose 16 to the sides of which three grooves 18, 18'' 18' 18'' have been formed so as to fixedly insert a second coupling device 1' into one of the grooves 18, 18' 18'' according to the convenience of the user. For the remaining two grooves 18' one is to be blocked with a plug 19 while an elbow 20 is to be inserted into the other.

In addition, where there is no rock drill being in use, the apparatus of the present invention may be connected to a compressed air hose 21 brought into the work site.

In the accompanying drawings, the reference numeral designated at 22 is a collection filter for a dustproof mask 10 and at 23 is a purification receptacle containing a counteragent for a gas mask 11.

The operation of the present invention is as follows:

A worker who wears a dustproof or gas mask according to the present invention may breathe clean air that passed the conventional filter 22 and purification receptacle 23 until he arrives at his work post.

Upon arrival at his work post, the coupling device 1 could simply be connected to either the first coupling device 17 of a rock drill 14 or to the second drill coupling adapter 1' connected to the compressed air hose 21. The the compressed air, the pressure of which has been reduced in accordance with the inhaling capacity of the wearer of the mask, initially passes through the supply channel 4 which is regulated by the pressure reduction bolt 3 and then through the purification receptacles 6, 9 containing carbon filters which separate solid particles, impurities, etc, thus providing the wearer of the mask with a constant supply of clean air without having to exercise efforts to draw a deep breath, resulting in the prevention of recipiratory disease and enhancement of work efficiency.

While the specific embodiments of the invention have been illustrated and described herein, it is realized that numerous modifications will occur to those skilled in the art. It is therefore to be understood that the appended claims are intended to cover all such modifications and changes as fall within the true spirit and scope of the invention.

What is claimed is:

1. An infusion apparatus for supplying compressed air into an industrial mask, comprising:

a T-shaped decompressing regulator having a first coupling device at a first end and an inner threaded portion at a second end;

an air supply channel formed in said regulator;

a pressure bolt inserted into said threaded portion to regulate the opening of said air supply channel;

a first purification receptacle, having a carbon filter disposed therein, provided immediately below said air supply channel;

a second purification receptacle, having a carbon filter disposed therein, fixedly attached to the industrial mask;

a hose linking said first and second purification receptacles; and an air exhaust hose arranged in a substantially circular loop having an end portion extending out of said mask and connected to said second purification receptacle.

2. The apparatus of claim 1, further including a drill coupling adapter having three grooves formed therein, said drill coupling adapter being provided between an oiler and compressed air hose of a rock drill.

3. The apparatus of claim 2, further including a second coupling device connected to said first coupling device which can be fixedly inserted into any of said three grooves of said drill coupling adapter.

4. The apparatus of claim 3, further including an elbow and a plug for insertion into the remaining two grooves of the drill coupling adapter.

5. The apparatus of claim 1, further including a compressed air hose connected to said regulator.

* * * * *